US012134515B2

(12) United States Patent
Argo, IV et al.

(10) Patent No.: US 12,134,515 B2
(45) Date of Patent: Nov. 5, 2024

(54) CHEMICAL AND BIOLOGICAL ISOLATION BAG

(71) Applicant: Applied Research Associates, Inc., Albuquerque, NM (US)

(72) Inventors: Theodore Francis Argo, IV, Beaverton, OR (US); Cortney LeNeave, Englewood, CO (US); Sarah Corniea, Denver, CO (US); Brian Zadler, Golden, CO (US)

(73) Assignee: Applied Research Associates, Inc., Albuquerque, NM (US)

( * ) Notice: Subject to any disclaimer, the term of this patent is extended or adjusted under 35 U.S.C. 154(b) by 0 days.

(21) Appl. No.: 18/192,475

(22) Filed: Mar. 29, 2023

(65) Prior Publication Data

US 2024/0327109 A1 Oct. 3, 2024

(51) Int. Cl.
*B65D 85/84* (2006.01)
*B65D 33/06* (2006.01)
*B65D 33/22* (2006.01)

(52) U.S. Cl.
CPC ..... *B65D 85/84* (2013.01); *B65D 33/06* (2013.01); *B65D 33/22* (2013.01)

(58) Field of Classification Search
CPC ..... B65D 85/84; B65D 85/82; B65D 85/70; B65D 33/06; B65D 33/22; B65D 33/20; B65D 33/18; B65D 33/1691; B65D 33/16; B65D 33/00; B65D 33/02; B65D 33/28; F16B 2/20
USPC ..... 206/223, 524.5; 222/566, 575
See application file for complete search history.

(56) References Cited

U.S. PATENT DOCUMENTS 3,999,653 A * 12/1976 Haigh ..... B65D 85/84 383/102
5,199,795 A * 4/1993 Russo ..... B65D 85/84 604/408
2005/0218032 A1* 10/2005 Maddock ..... B65D 77/003 206/823
2006/0021897 A1* 2/2006 Dickinson ..... B65D 5/4233 206/778
2007/0095712 A1* 5/2007 Miles ..... B65D 77/062 206/524.8
2013/0266848 A1* 10/2013 Shannon ..... H01M 50/103 29/623.2

* cited by examiner

*Primary Examiner* — Javier A Pagan
(74) *Attorney, Agent, or Firm* — Erise IP, P.A.

(57) ABSTRACT

An isolation bag for transporting objects of an unknown nature is provided. The isolation bag comprises a chemically resistant storage container, an adhesive dispensing apparatus, and a carrier. The chemically resistant storage container comprises a chemically etched portion to promote bonding with an adhesive material dispensed by the adhesive dispensing apparatus. The adhesive dispensing apparatus slides along the top of the storage container depositing adhesive and sealing the storage container. The sealed storage container is placed in a dual lined carrier. The dual lined carrier has an out an outer shell having a first color, an interior lining having a second contrasting color, and a storage pouch for receiving the storage container. In the event of a puncture, cut, or breach of the outer shell, the contrasting color of the interior lining provides an indication of the breach.

20 Claims, 10 Drawing Sheets

CHEMICAL AND BIOLOGICAL ISOLATION BAG

TECHNICAL FIELD

Embodiments of the present disclosure provide an apparatus for safe transport and disposal of contaminated objects.

BACKGROUND

During military, humanitarian, and other operations, objects contaminated with chemical, biological, or other hazardous materials, such as undetonated explosive devices, may be encountered. These contaminated objects may pose health and safety risks unless the object is accurately identified and handled. However, when handling such hazardous materials, care must be taken to prevent inadvertent detonation and/or to prevent contamination.

SUMMARY

In some aspects, the techniques described herein relate to an isolation bag for transporting objects containing a chemical or biological substance, the isolation bag including: a storage container, the storage container including: a first sealed sidewall and a second sidewall having a selectively transitional opening; and a storage space for inserting an object into the storage container; wherein at least a first portion of the storage container is constructed from a chemically resistant material and at least a portion of the second sidewall is chemically etched; an adhesive dispensing apparatus including: a dispenser, the dispenser including: an inlet opening located at a distal end of the dispenser; an outlet opening located at a proximal end of the dispenser; a channel disposed within an interior of the dispenser and defined by the inlet opening and the outlet opening; an adhesive spreader at least partially disposed within the channel, including: a vertical channel, and a plurality of dispensing outlets fluidly coupled to the vertical channel, a neck including a void space that is fluidly coupled to the vertical channel; a selectively removable adhesive container for dispensing glue into the channel, the adhesive container including: a housing for storing an adhesive material; a threaded end including a void space; wherein the adhesive container is selectively insertable into the neck of the dispenser, wherein the void space is fluidly coupled to the vertical channel for transferring adhesive from the housing to the adhesive spreader; a carrier, the carrier including: an outer shell having a first color; an interior lining having a second contrasting color; a storage pouch for receiving the storage container; and at least one fastener for closing the carrier.

In some aspects, the techniques described herein relate to an adhesive dispensing apparatus for sealing a container, the apparatus including: an adhesive dispensing apparatus including: a dispenser, the dispenser including: an inlet opening located at a distal end of the dispenser; an outlet opening located at a proximal end of the dispenser; a channel disposed within an interior of the dispenser and defined by the inlet opening and the outlet opening; an adhesive spreader at least partially disposed within the channel, including: a vertical channel; and a plurality of dispensing outlets fluidly coupled to the vertical channel; a neck including a void space that is fluidly coupled to the vertical channel; a selectively removable adhesive container for dispensing glue into the channel, the adhesive container including: a housing for storing an adhesive material; a threaded end including a void space; wherein the adhesive container is selectively insertable into the neck of the dispenser, wherein the void space is fluidly coupled to the vertical channel for transferring adhesive from the housing to the adhesive spreader.

In some aspects, the techniques described herein relate to a method of instructing insertion and transportation of an object having unknown characteristics in an isolation bag, the method including: providing the isolation bag including a storage container, an adhesive dispensing apparatus, and a carrier; said storage container including: a first sealed sidewall and a second sidewall having a selectively transitional opening; and a storage space for inserting an object into the storage container; wherein at least a first portion of the storage container is constructed from a chemically resistant material and at least a portion of the second sidewall is chemically etched; said adhesive dispensing apparatus including: a dispenser, the dispenser including: an inlet opening located at a distal end of the dispenser; an outlet opening located at a proximal end of the dispenser; a channel disposed within an interior of the dispenser and defined by the inlet opening and the outlet opening; an adhesive spreader at least partially disposed within the channel, including: a vertical channel, and a plurality of dispensing outlets fluidly coupled to the vertical channel, a neck including a void space that is fluidly coupled to the vertical channel; a selectively removable adhesive container for dispensing glue into the channel, the adhesive container including: a housing for storing an adhesive material; a threaded end including a void space; wherein the adhesive container is selectively insertable into the neck of the dispenser, wherein the void space is fluidly coupled to the vertical channel for transferring adhesive from the housing to the adhesive spreader; said carrier including: an outer shell; an interior lining; a storage pouch for receiving the storage container; and at least one fastener for closing the carrier; instructing placement of an object into the storage container; instructing sealing of the storage container using the adhesive dispensing apparatus, wherein the adhesive dispensing apparatus dispenses adhesive material into the selectively transitional opening, after sealing of the storage container, instructing placement of storage container into the storage pouch; and instructing closing of the carrier using the at least one fastener.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present disclosure will be apparent from the following detailed description of the embodiments and the accompanying drawing figures.

BRIEF DESCRIPTION OF THE DRAWING FIGURES

Embodiments of the present disclosure are described in detail below with reference to the attached drawing figures, wherein.

Figure 1:
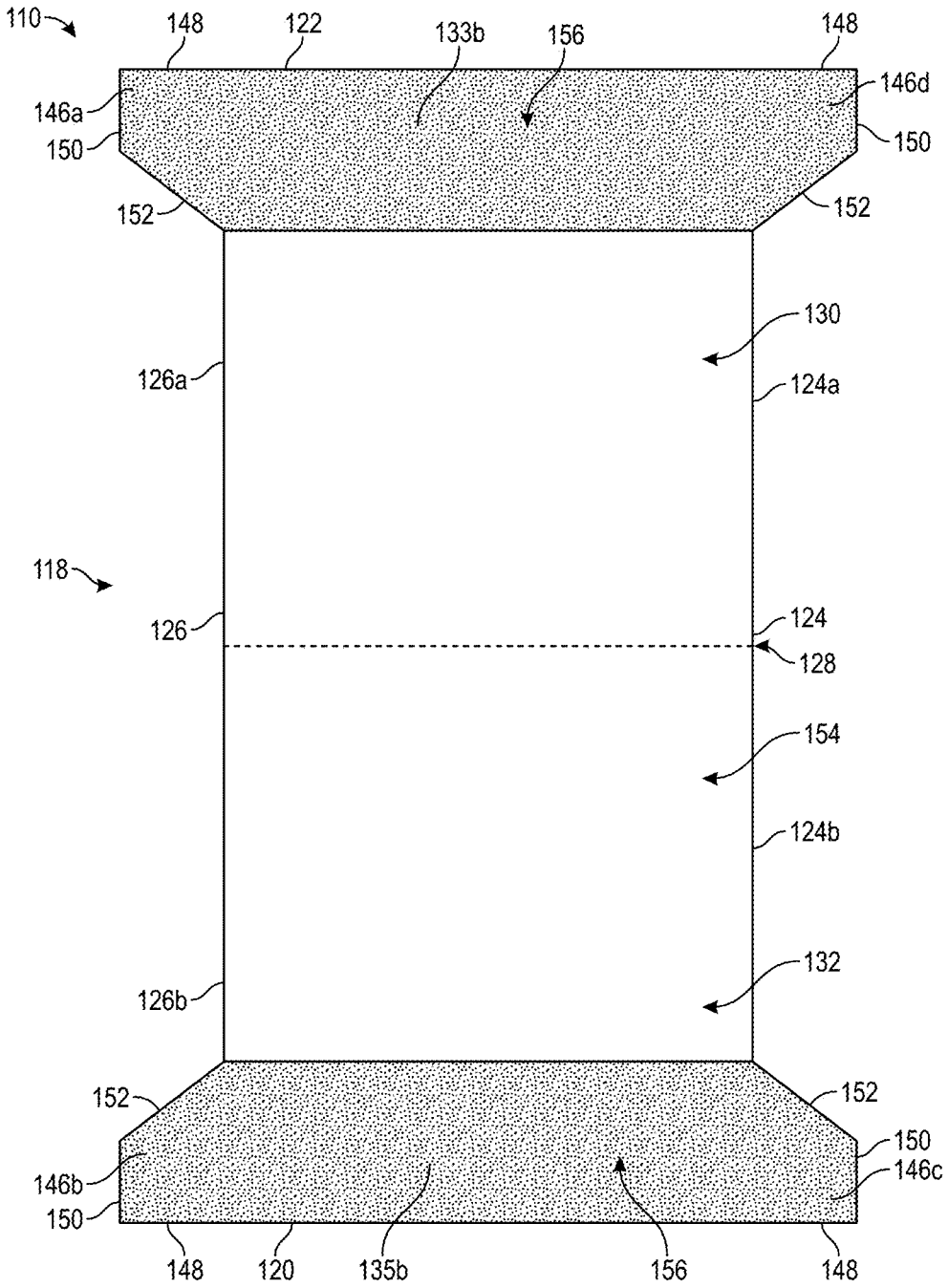
FIG. 1 depicts one example of a blank for forming a storage container of an isolation bag.

The drawing figures do not limit the present disclosure to the specific embodiments disclosed and described herein. The drawings are not necessarily to scale, emphasis instead being placed upon clearly illustrating the principles of the present disclosure.

DETAILED DESCRIPTION

The following detailed description of embodiments of the present disclosure references the accompanying drawings that illustrate specific embodiments in which the present disclosure can be practiced. The embodiments are intended to describe aspects of the present disclosure in sufficient detail to enable those skilled in the art to practice the present disclosure. Other embodiments can be utilized, and changes can be made without departing from the scope of the present disclosure. The following detailed description is, therefore, not to be taken in a limiting sense. The scope of the present disclosure is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments but is not necessarily included. Thus, the present technology can include a variety of combinations and/or integrations of the embodiments described herein.

Existing apparatus and systems for transporting objects of an unknown nature are limited in providing transportation capabilities for such objects. Further, chemically unreactive storage containers are difficult to seal, especially for an operator in the field who may be wearing gloves or other protective gear. Even further, known storage containers that provide protection from puncturing or abrasions are often made from materials that may cause an unintended chemical reaction with the object.

The present disclosure solves the limitations and deficiencies of the prior art by providing a multiple component isolation bag 100 for the transportation of potentially hazardous chemical or biological objects or substances of an unknown risk from an initial location for disposal or testing of the object. The isolation bag 100 comprises a chemically resistant storage container 102, an adhesive dispensing apparatus 104, and a carrier 300. As described in detail herein, the chemically resistant storage container 102 is a chemically stable and flexible bag for holding an object of unknown properties. The storage container 102 is sealed with the adhesive dispensing apparatus 104, allowing an operator that is wearing gloves or personal protective gear to seal the storage container 102 without removing the gloves. Additionally, the sealed storage container 102 is protected from physical damage by insertion into a carrier 300. The carrier 300 is durable, providing protection from abrasions and punctures while also providing protection from a physical force.

Chemically Resistant Storage Container

Figure 2:
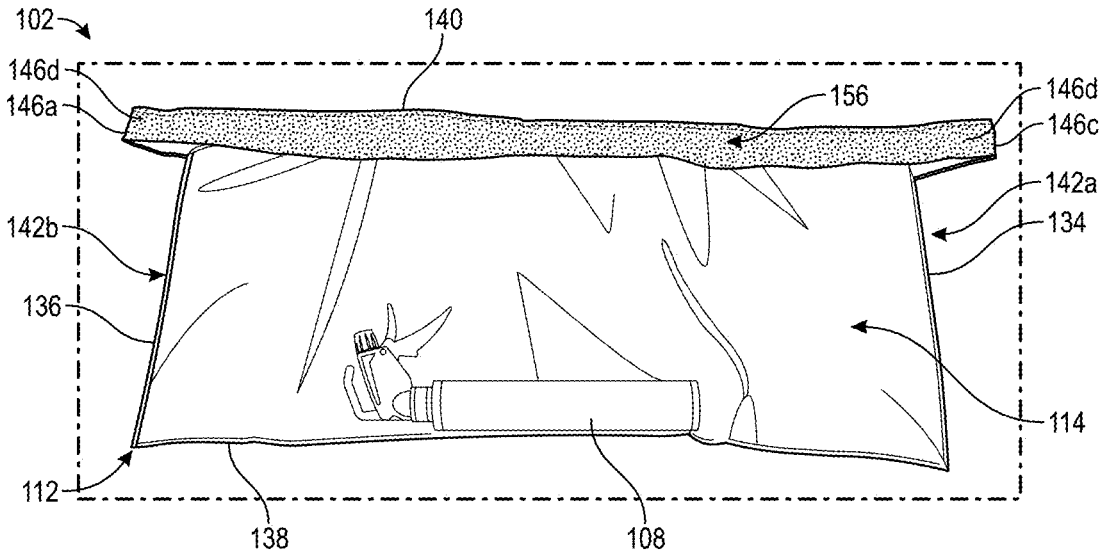
FIG. 2 depicts one example of a perspective view of the storage container.
Figure 3:
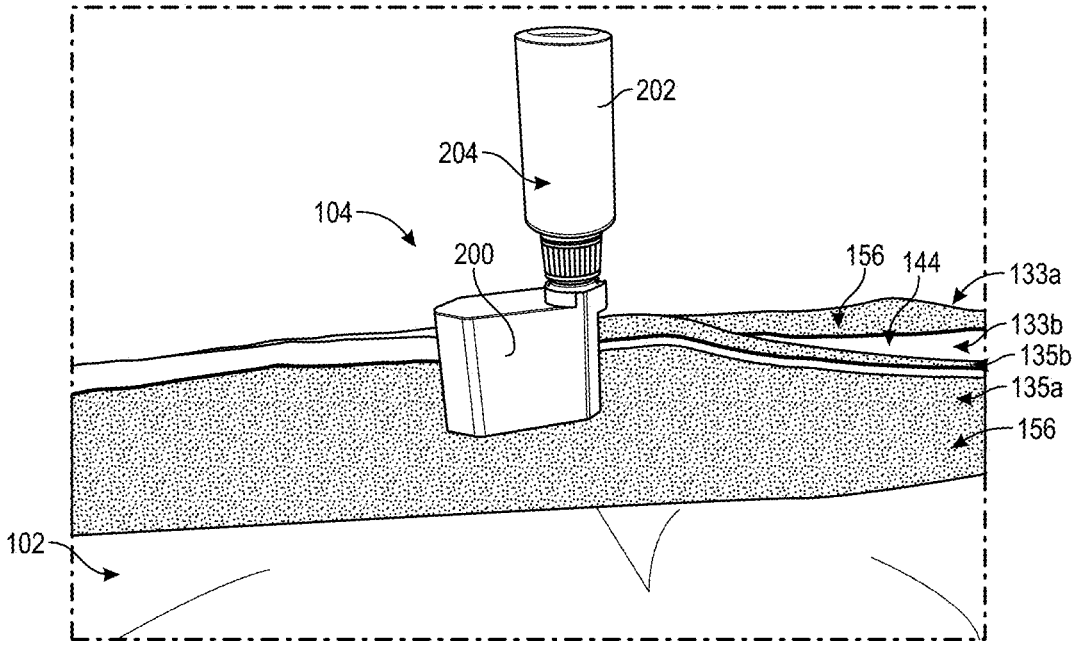
FIG. 3 depicts one example of an adhesive dispensing apparatus positioned on the top of a storage container.

As depicted in FIGS. 1-3, the chemically resistant storage container 102, or more generally storage container 102, is a bag, sack, or other container for the transportation of an object 108 of unknown properties, such as an object 108 suspected of causing a chemical, biological, radiological, or other hazard. The storage container 102 comprises a blank 110 that is folded to form a perimeter sidewall 112, a storage space 114 for storing object 108, and a chemically etched portion 156 for bonding with an adhesive and sealing the storage container 102.

As best depicted in FIG. 1, the storage container 102 can be constructed from a flat sheet or single blank of material that is die cut or otherwise formed from a larger sheet or roll of material. The blank 110 is the initial state of the storage container 102 prior to any folding or manipulation. The blank 110 provides the basis for the final geometric shape and design of the storage container 102. After cutting from the larger sheet or roll of material, the blank is defined by a perimeter sidewall 118, providing the shape, design, and boundary of the blank 110. In embodiments, the perimeter sidewall 118 comprises an inferior sidewall 120, a superior sidewall 122, a right sidewall 124, and a left sidewall 126.

To form the storage container 102, the blank 110 is folded at a fold line 128. The fold line 128 is located at approximately the center of the blank 110, equidistant from the superior sidewall 122 and the inferior sidewall 120. In embodiments, the fold line 128 may comprise score lines to facilitate folding. In further embodiments, the fold line 128 may have no clear definition or delineation.

The fold line 128 further defines a first portion 130 and a second portion 132 of equal sizes, joined together at the fold line 128. Accordingly, the fold line divides the right sidewall 124 into right sidewall **124*a* and right sidewall 124*b* and further divides the left sidewall 126 into left sidewall 126*a* and left sidewall 126*b*, with half of each corresponding to each of the first portion 130 and the second portion 132. Accordingly, the first portion 130 is defined by the superior sidewall 122, the right sidewall 124*a*, the fold line 128, and the left sidewall 126*a*; and the second portion 132 is defined by the inferior sidewall 120, the right sidewall 124*b*, the fold line 128, and the left sidewall 126*b***.

Transitioning the blank 110 to the storage container 102 comprises folding the blank 110 and sealing the perimeter sidewall 118. When folded, the second portion 132 lays on top of first portion 130 such that the superior sidewall 122 lays flush with the inferior sidewall 120; the right sidewall **124*a* lays flush with the right sidewall 124*b* forming a right storage sidewall 134 and the left sidewall 126*a* lays flush with the second left sidewall 126*b* forming a left storage sidewall 136. Further, once folded, the fold line 128 is now located at the bottom of the storage container, becoming the bottom storage sidewall 138 of the storage container 102. Finally, the inferior sidewall 120 laying flush with the superior sidewall 122 forms the top sidewall 140 of the storage container 102**.

Once folded, portions of the perimeter sidewall 118 can be sealed to maintain the shape of the storage container 102 and to provide a seal to prevent solids, liquids, gas, and/or foreign objects from entering the interior of the storage container 102 and to prevent solids, liquids, gas, and/or foreign objects from exiting the interior of the storage container 102 via the seams.

The sealing of the perimeter sidewall 118 may be accomplished through a variety of methods, depending on the required degree of sealing. By way of non-limiting example, the perimeter sidewall 118 may be sealed through heat sealing, providing for heat sealed seams. For example, when folded and laid on top of one another, each of the right storage sidewall 134 and left storage sidewall 136 can be heat sealed, thereby sealing the right sidewall 124*a* to the right sidewall 124*b* and sealing the left sidewall 126*a* to the left sidewall 126*b*. Accordingly, after the heat-sealing treatment, the storage container 102 comprises heat sealed seams 142*a* and 142*b* corresponding to right storage sidewall 134 and left storage sidewall 136 respectively.

In embodiments, portions of the perimeter sidewall 118 are not heat sealed. For example, after folding the blank 110, the fold line 128 becomes the bottom storage sidewall 138. As described above, the fold line 128 may be an unbroken or unaltered portion of the blank 110, merely being the equidistant location between inferior sidewall 120 and the superior sidewall 122. The bottom storage sidewall 138 is uncut, unpierced, and retains the impermeable properties of the blank 110. Accordingly, because the bottom storage sidewall is an unbroken line of impermeable material, the bottom storage sidewall requires no adhesive, sealant, or bonding. In further embodiments however, the bottom storage sidewall may optionally and/or additionally be heat sealed. For example, the bottom storage sidewall may be heat sealed to provide additional strength or structure to the storage container 102 or to close or seal any openings or voids in the bottom storage sidewall caused during the manufacturing process. Additionally, in further embodiments, the storage container 102 may be constructed from two separate blanks 110 and the bottom storage sidewall may be heat sealed to form the storage container 102.

The top sidewall 140 of the storage container 102 is initially open, such that the first portion 130 and the second portion 132 are not joined together or bonded, until at a later time. Accordingly, the top sidewall 140 acts an opening 144 of the storage container 102, providing access to storage space 114. The opening 144 of the storage container 102 extends the entire length of the top sidewall 140, separating the first portion 130 from the second portion 132. Accordingly, the separating of first portion 130 from the second portion 132 allows a user to access the interior of the storage container 102, i.e., the storage space 114.

The storage space 114 is the interior of the storage container 102, providing the space for the holding and containing of object 108. The dimensions of the storage space 114 is defined by both the perimeter sidewall 118 and the first portion 130 and the second portion 132. Accordingly, the storage space 114 compromises the volumetric dimensions defined by the distance between the left sidewall 126 and the right sidewall 124; the distance between the bottom storage sidewall 138 and the top sidewall 140; and the distance between the first portion 130 and the second portion 132.

In further embodiments, the storage container 102 may be constructed through heat leasing two separate but identical blanks 110 rather than through folding a single blank 110. For example, a first blank 110 and a second blank 110 may be laid on top of one another and the edges of the perimeter sidewall 112 heat sealed as described above.

Storage Container Tabs

In embodiments, the blank 110 comprises at least one tab, or extending member that extend away from the blank 110. In embodiments, the tab may be formed through the cutting of the blank 110, leaving a jutting or protruding portion away from the blank 110. In embodiments, the tab comprises a generally rectangular design, having a top side 148, a distal side 150, and a bottom side 152. However, the tabs may comprise any geometric shape.

As depicted in FIG. 1, the blank 110 may comprise four tabs 146*a*, 146*b*, 146*c*, and 146*d* may be positioned at four corners of the blank 110, corresponding to the intersections of the perimeter sidewall 118. Tab 146*a* is positioned at approximately the intersection of superior sidewall 122 and left sidewall 126; tab 146*b* is positioned at approximately left sidewall 126 and inferior sidewall 120; tab 146*c* is positioned at approximately the junction of inferior sidewall 120 and right sidewall 124; and tab 146*d* is positioned at approximately the junction of right sidewall 124 and superior sidewall 122. Accordingly, the positioning of the tabs increases the total length of the perimeter sidewall 118. Specifically, tabs 146*a* and 146*d* increase the overall length of the superior sidewall 122; tabs 146*a* and 146*b* increase the overall length of the left sidewall 126; tabs 146*b* and 146*c* increase the overall length of the inferior sidewall 120; tabs 146*c* and 146*d* increase the overall length of the right sidewall 124.

Similar to how first portion 130 lays on top of second portion 132 after folding, a first tab also lays on top of a second tab. For example, after folding, tab 146*b* lays on top of tab 146*a* and tab 146*c* lays on top of tab 146*d*. Accordingly, once folded, the tabs result in an increased length of each of the top sidewall 140. As described in greater detail below, the increased length of the top sidewall 140 provides increased surface area for the attachment of the adhesive dispensing apparatus 104.

Chemical Properties of the Storage Container

In embodiments, the storage container 102 is used to transport objects 108, which may comprise unknown compositions, origins, or other features. For example, as described above, in certain situations, storage container 102 may be deployed in battlefield environments and used to transport undetonated explosives. Such undetonated explosives may be chemically sensitive, and reactive to certain materials used to construct previously developed containers. Accordingly, in embodiments, blank 110 is manufactured or constructed from a chemically neutral, chemically resistant, or non-reactive material 154 and comprises a chemically etched portion 156. Constructing blank 110 from such a non-reactive material 154 aids in preventing or eliminating inadvertent reaction of the object 108 while stored in the storage space 114.

In embodiments, the non-reactive material 154 may be any suitable material, including but not limited to Polytetrafluoroethylene ("PTFE", including the PTFE-based composition sold under Teflon® or Crossfilm™). However, other non-reactive material may be utilized in manufacturing and constructing the blank 110. For example, the non-reactive material 154 can be other variations of tetrafluoroethylene or other fluorocarbons.

Constructing blank 110 from a fluorocarbon is particularly advantageous because of the stability of the carbon-fluorine bond, rendering the blank 110 stable and non-reactive. Specifically, the carbon-fluorine bond of Tetrafluoroethylene is one of the strongest single bonds in organic chemistry, due to its partial ionic character. When constructing blank 110 from PTFE or Tetrafluoroethylene, the storage container 102 retains the stable and unreactive characteristics of the carbon-fluorine bond. Accordingly, objects 108 of unknown properties and characteristics may be safely stored within the storage container 102 with a reduced, or even eliminated, risk of a chemical reaction or permeation. Safe transport of the object 108, serves a dual role of protecting the carrier of the isolation bag 100 and maintains the integrity and status of the object 108 for future testing.

For example, in scenarios in which the isolation bag 100 is deployed in a warzone, and the object 108 may be a chemical weapon or weapons payload carrying chemical agents which may interact with or contaminate the material of standard issue transportation bags or articles. A soldier may place the object in the soldier's infantry bag, which may interact with the material of the bag or the residue of previously stored objects, causing contamination. Such contamination may place the soldier and/or nearby persons in danger. In further scenarios, a chemical reaction between the object 108 and a storage unit may cause damage or alter the object 108. For example, in a laboratory, medical, or other sterile scenario, maintaining the fidelity of the object 108 is important for testing purposes or for later use of the object 108. Accordingly, even minor reactions or alterations to the object 108 may render the object 108 unusable for further testing, affect the fidelity of testing, and/or render the object 108 unusable for further use.

Additionally, constructing blank 110 from PTFE or other similar material provides advantage of providing a flexible, formable, and/or generally manipulative container. For example, following the insertion of the object 108 into the storage container 102, the storage container 102 may be folded, crumpled, or bundled for insertion into a larger carrying unit, including carrier 300 as described below, in a pocket of the operator, or in another storage unit.

Chemically Etched Portion

The chemically etched portion 156 covers at least a portion of the blank 110 and is a chemically treated surface region of the non-reactive material 154. In embodiments, the chemically stable and non-reactive characteristics of the non-reactive material 154 may inhibit or increase difficulty in sealing the storage container 102 using certain methods of adhesion. To promote the application and bonding of an adhesive material, the non-reactive material 154 of the blank 110 is chemically treated to create the chemically etched portion 156. The chemical treatment of the non-reactive material alters the surface chemistry of the non-reactive material 154, decreasing the fluorine-to carbon atomic ratio to promote the formation of chemical bonds. Specifically, decreasing the fluorine-to-carbon atomic ratio promotes the bonding of an adhesive to the blank 110 at the chemically etched portion 156.

The surface treatment of the non-reactive material 154 of the blank 110 to create the chemically etched portion 156 may be performed using a variety of surface treatment methods. For example, the non-reactive material 154 may be treated using sodium etching of the blank 110. The sodium solution may for example, comprise a combination of sodium naphthalene and glycol-ether (glyme) solution, but any sodium solution may be utilized. The sodium etching process comprises wetting the surface of the blank 110 with either an immersion or coating of the blank in the sodium solution. In embodiments, the process may be performed at a temperature of approximately 50° C. to cause the etchant to release more sodium.

While the sodium etching surface treatment of the blank 110 is an entirely chemical process, physical or visible changes to the blank may occur. For example, chemical etching of the non-reactive material 154 using a sodium solution results in a highly porous defluorinated layer. This causes a visible alteration to the blank, displaying a discolored or "cracked" appearance.

In further embodiments, other techniques may be utilized during the surface treatment of the blank 110. For example, in some embodiments, plasma etching may be utilized. In plasma etching, the non-reactive material is exposed to plasma. Similar to the sodium chemical etching, plasma etching also defluorinates the non-reactive material and drops the fluorine-to carbon atomic ratio. In even further embodiments, ion beam and laser treatment of the blank may be utilized.

In embodiments, the surface treatment of the blank 110 occurs prior to the folding and sealing of the blank to form the storage container 102. In such an embodiment, each end of the blank 110, i.e., the superior sidewall 122 and the inferior sidewall 120, are treated to impart the surface treatment. After treatment, the blank 110 is folded and sealed. In further embodiments, the blank 110 is treated after folding and sealing to form the storage container 102. In such an embodiment, the top sidewall 140 is treated to impart the surface treatment.

As depicted, the chemically etched portion 156 covers a pre-determined surface area of each of the first portion 130 and the second portion 132. In embodiments, the chemically etched portion 156 is located approximate to the opening 144 of the storage container 102, to aid in facilitating the selective closing of the opening 144 and the storage container 102, as described in greater detail below. In embodiments, the chemically etched portion 156 is located on both the exterior surface 133*a* and the interior surface 133*b* of the first portion 130 and the exterior surface 135*a* and the interior surface 135*b* of the second portion 132. In further embodiments, the chemically etched portion 156 is located on only the interior surface 133*b* of the first portion 130 and the interior surface 135*b* of the second portion 132.

For example, in embodiments, starting from the inferior sidewall 120 and moving towards the fold line 128, the chemically etched portion 156 may be cover at least 5%, at least 10%, at least 15%, at least 20% or greater than or equal to 25% of the interior surface 133*b* of the first portion 130. In embodiments, starting from the inferior sidewall 120 and moving towards the fold line 128, the chemically etched portion 156 may be cover at least 5%, at least 10%, at least 15%, at least 20% or greater than or equal to 25% of the exterior surface 133*a* of the first portion 130. In embodiments, starting from the superior sidewall 122 and moving towards the fold line 128, the chemically etched portion 156 may be cover at least 5%, at least 10%, at least 15%, at least 20% or greater than or equal to 25% of the interior surface 135*b* of the second portion 132. In embodiments, starting from the inferior sidewall 120 and moving towards the fold line 128, the chemically etched portion 156 may be cover at least 5%, at least 10%, at least 15%, at least 20% or greater than or equal to 25% of the exterior surface 135*a* of the second portion 132.

Adhesive Dispensing Apparatus

Turning to FIGS. 3-10, an exemplary embodiment of the adhesive dispensing apparatus 104 is depicted. The dispensing apparatus 104 is used to deliver adhesive to the storage container 102 after the object 108 has been inserted into the storage space 114 thereby sealing the object 108 inside. The adhesive dispensing apparatus 104 comprises a dispensing zipper 200 for spreading adhesive and an adhesive container 202 for storing and holding adhesive material 204. In embodiments, the adhesive dispensing apparatus 104 is further paired with a curing apparatus 206 for curing the adhesive material 204 after dispensing.

Dispensing Zipper

The dispensing zipper 200 comprises a zipper housing 208 and an adhesive spreader 210. The dispensing zipper 200 provides a tool that a user can manipulate and operate to dispense adhesive material 204 to seal the storage container 102.

The zipper housing 208 provides the interface for a user to manipulate and move the dispensing zipper 200 to dispense adhesive material 204 comprising an outer surface 212, a channel 214 and a neck 216. The zipper housing 208 is a molded or formed piece of material having a predetermined shape and design. For example, in embodiments, the zipper housing 208 comprise a generally rectangular shape. In embodiments, the size of the zipper housing 208 may be determined on the dimensions of the storage container 102.

The channel 214 of the zipper housing 208 is an opening, void space, or passage defined within the interior dimensions of the zipper housing 208, providing a continuous opening through the zipper housing 208. The channel 214 is defined by an inlet 220 corresponding to a proximal end 222 of the zipper housing 208 and an outlet 224 corresponding to a distal end 226 of the zipper housing 208. In embodiments, a bottom portion 228 of the zipper housing 208 is open-ended from the proximal end 222 to the distal end 226 giving the zipper housing 208 a general "U" shape.

The inlet 220 of the channel 214 is defined into the proximal end 222 of the zipper housing 208, providing a first opening of the channel 214. In embodiments, the inlet 220 is a single, continuous opening in the zipper housing 208. As described in greater detail below, the zipper housing 208 is positioned on the top sidewall 140 of the storage container 102

Accordingly, with the channel 214 defining a passageway throughout the interior of the zipper housing 208, the zipper housing 208 further comprises an interior sidewall 230. The interior sidewall 230 comprises a right inner sidewall 232, a top inner sidewall 234, and a left inner sidewall 236. As described above, the bottom portion 228 of the zipper housing 208 is open-ended, and the interior sidewall 230 does not comprise a bottom inner sidewall.

The depth or size of the channel 214, and by extension the distance between the right inner sidewall 232 and the left inner sidewall 236 may comprise a degree of variance, such that the depth of the channel 214 may vary along its length. The distance between the right inner sidewall 232 and the left inner sidewall 236 may be approximately 50 micrometers to approximately 200 micrometers. For example, as described in greater detail below, movement of the dispensing zipper 200 along the top sidewall 140 presses each of the first portion 130 and the second portion 132 together. Accordingly, the channel 214 may comprise a greater depth at the proximal end 222 or inlet 220 as the first portion 130 and second portion 132 enter into the channel 214 and comprises a shallower depth at the distal end 226 or outlet 224 to cause first portion 130 and second portion 132 to press together.

As described in greater detail below, portions of the storage container 102 engage with the interior sidewall 230 during the depositing of adhesive material 204. To aid in spreading adhesive material 204, portions of the interior sidewall 230 comprise at least one groove 238 to aid in spreading the adhesive material 204. The at least one groove 238 is a trench defined in the interior sidewall 230 of the zipper housing 208. In embodiments, the groove 238 extends a predetermined length of the interior sidewall 230. For example, the groove 238 may extend along the interior sidewall 230 from the inlet 220 to the outlet 224. To aid in providing an even coating of adhesive material 204, each of right inner sidewall 232 and left inner sidewall 236 comprises at least one groove 238 extending the entire length of the right inner sidewall 232 and left inner sidewall 236.

Figure 4:
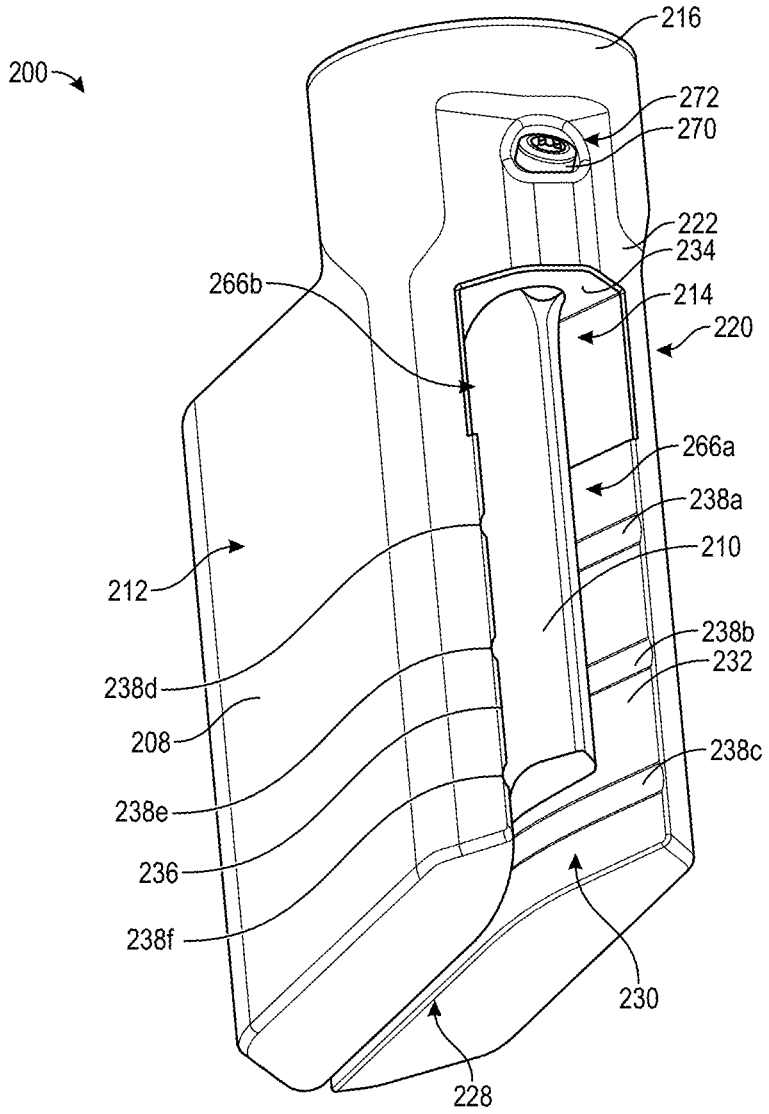
FIG. 4 depicts one example of a first perspective view of a dispensing zipper.
Figure 5:
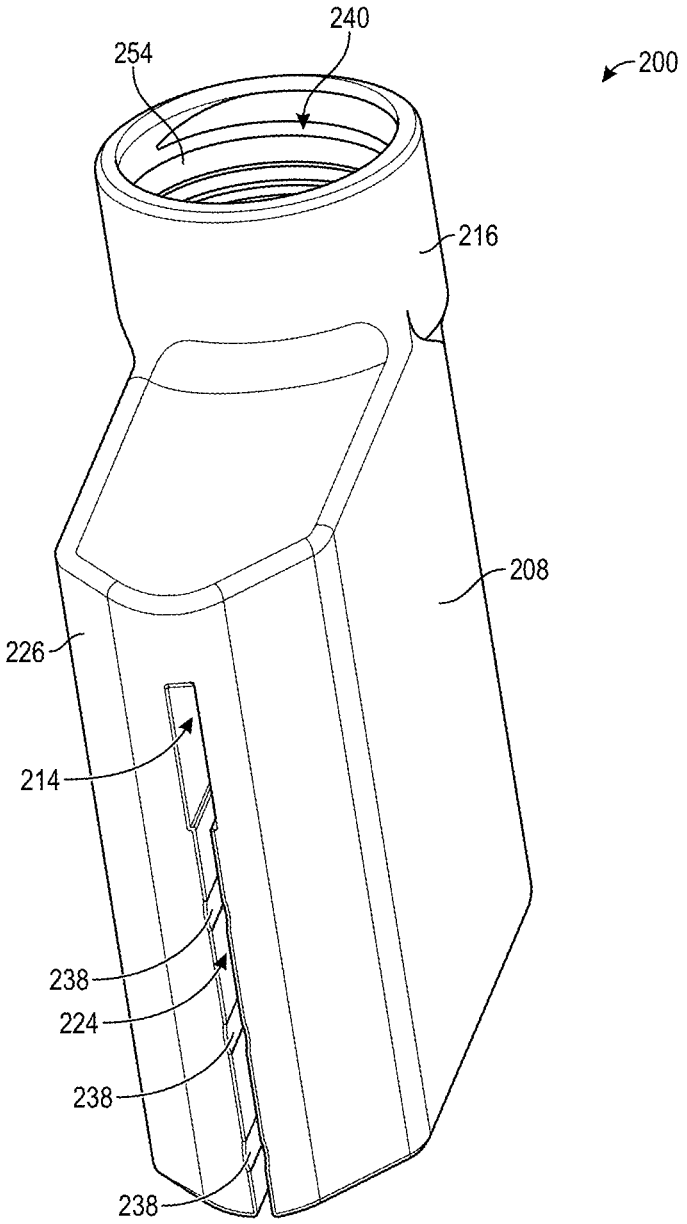
FIG. 5 depicts one example of a second perspective view of a dispensing zipper.
Figure 6:
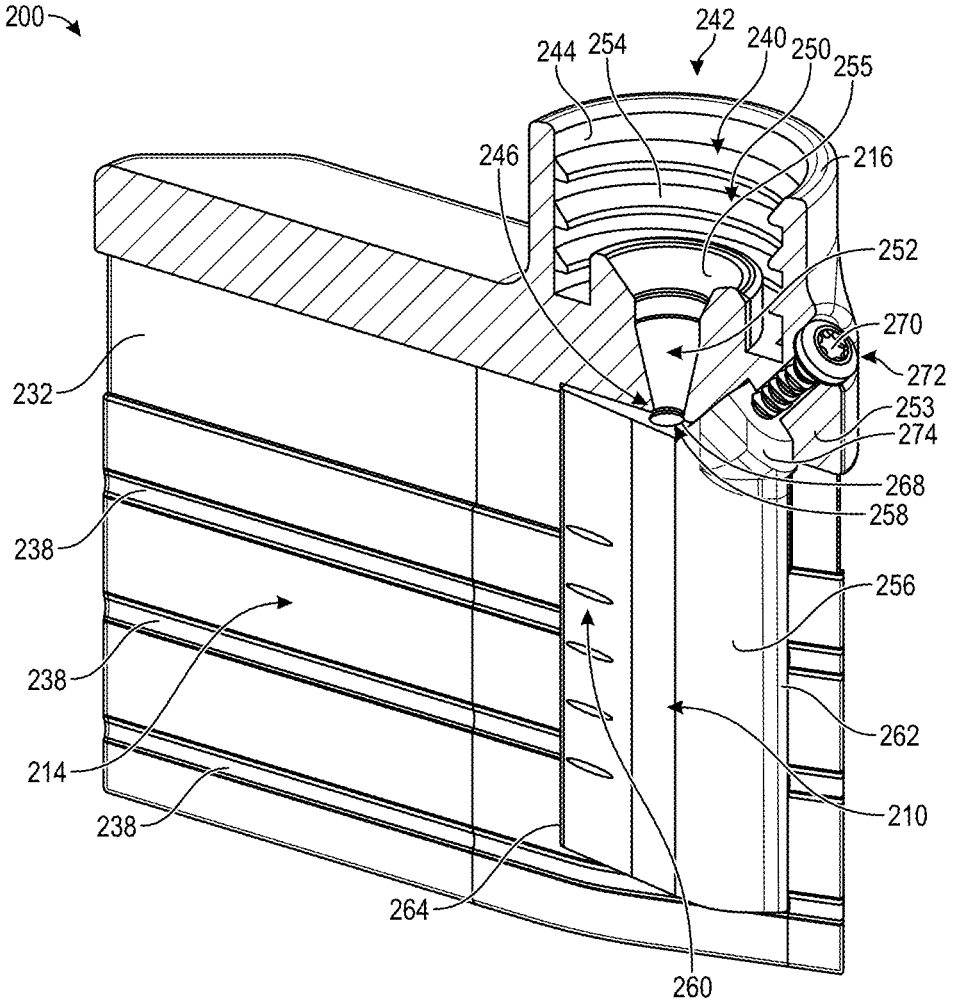
FIG. 6 depicts one example of a cross-sectional view of a dispensing zipper.

For example, in the exemplary embodiment depicted in FIGS. 4-6, the right inner sidewall 232 comprises grooves 238*a*, 238*b*, 238*c* and left inner sidewall 236 comprises grooves 238*d*, 238*e*, and 238*f*. The grooves 238 may be spaced along a length of the interior sidewall 230. For example, the space between each groove may be approximately 0.5 millimeters to approximately 2.5 milters.

In embodiments, the grooves 238 may be paired, such that a first groove on the right inner sidewall 232 and corresponding a second groove on the left inner sidewall 236 are mirrored in position. For example, the positioning of groove 238*a* is mirrored by groove 238*d*; groove 238*b* is mirrored by groove 238*e*; and groove 238*c* is mirrored by groove 238*f*. This mirroring may further provide a generally cylindrical shape for each groove pairing.

As depicted in FIGS. 4-6, the neck 216 is an extending portion, extending away from the zipper housing 208, providing an attachment point for the adhesive container 202. In embodiments, the neck 216 comprises a cylindrical design. In embodiments, the neck 216 comprises an internally located neck channel 240. The neck channel 240 is a pathway, opening, or other void space located within the neck 216. The neck channel 240 is defined through the length of the neck 216, starting at an opening 242 located at the superior end 244 of the neck 216 and terminating at an opening 246 located at the inferior end of the neck 216. The opening 246 is flushed or otherwise opens into channel 214, providing for a continuous fluid pathway from opening 242 to the channel 214.

In embodiments, the neck channel 240 comprises varying or otherwise non-uniform dimensions, including for example varying circumference. For example, the neck channel comprises a superior channel 250 and an inferior channel 252 transitionally separated by a shelf 253. In embodiments, the superior channel 250 comprises a greater circumference than the circumference of the inferior channel 252. The superior channel 250 comprises dimensions compatible for mating with the adhesive container 202. For example, the superior channel 250 comprises a diameter of about 0.704 inches by 0.465 inches. In embodiments, the circumferential perimeter of the superior channel 250 comprises threading 254. The threading 254 of the superior channel 250 may correspond to threading of the of the adhesive container 202, as described in greater detail below for screwing and cooperatively mating the adhesive container 202 to the dispensing zipper 200.

The shelf 253 is the transitional layer or area of the neck 216 separating the wider circumference superior channel 250 from the narrower circumference inferior channel 252.

For example, the inferior channel 252 may be drilled or otherwise defined within the dimensions of the shelf 253. Accordingly, the shelf 253 provides a clear delineation between the superior channel 250 and the inferior channel 252 rather than a gradient or tapering of the superior channel 250 into the inferior channel 252. Additionally, the shelf 253 further provides a surface area for engaging with the adhesive container 202, providing a stopping point for the adhesive container 202 when inserted into the neck channel 240.

The inferior channel 252, which may be located within the shelf, is a channel fluidly coupled to the superior channel 250. In embodiments, the inferior channel 252 comprises a tapered channel, narrowing prior to emptying into the channel 214. In embodiments, the inferior channel 252 comprises a smaller circumference than the circumference of the superior channel 250. The decrease in circumference provides a dual benefit of fitting the inferior channel 252 within the shelf 253 while also providing decreases in volume for the flow of adhesive material, increasing the pressure applied to the adhesive material.

The neck channel 240 feeds into the channel 214, fluidly coupling the neck channel 240 to the channel 214. As described in greater detail below, after connecting the adhesive container 202 to the dispensing zipper 200, adhesive material 204 is transported from the adhesive container 202 to the channel 214 via the neck channel 240.

As described in greater detail below, embodiments of the adhesive container 202 comprise a protective film or tamper proof lid. To aid in removing the protective film or the tamper proof lid, the neck channel 240 may optionally comprise a cutting device 255 to cut, pierce, puncture, and/or break through the protective film or tamper proof lid while threaded into place. In embodiments, the cutting device 255 is positioned on the shelf 253, engaging with the protective film or tamper proof lid when the adhesive container 202 is inserted into the neck 216. Particularly, as the adhesive container 202 is threaded or inserted into the neck 26, the cutting device 255 engages with and pierces the protective film or tamper proof lid. In embodiments, the cutting device 255 is a point or jagged tip located on the shelf 253. Accordingly, as the adhesive container 202 is threaded into the neck 216, the point pierces and/or punctures the protective film. As the adhesive container 202 continues to be threaded and rotated, the cutting device 255 creates a circular cut into the protective film. In further embodiments, the cutting device is a circular blade or continuous circular tip disposed on the shelf 253 surrounding the inferior channel 252. Similarly, as the adhesive container 202 is threaded or inserted into the neck 216, the cutting device 255 pierces the protective film.

Adhesive Spreader

The adhesive spreader 210 is an apparatus positioned within the channel 214. The adhesive spreader 210 comprises a bladed body 256, a spreader channel 258, and a plurality of spreader openings 260. The bladed body 256 comprises a tapered body shape, resembling a knife blade, comprising a blunted edge 262 tapering to a tapered tip 264. The bladed body 256 comprises dimensions for placement within the channel 214. Additionally, the bladed body 256 comprises a thickness that is less than the thickness of the channel 214, providing for some spacing or a gap 266*a*, 266*b* between the bladed body 256 and each of the right inner sidewall 232 and the left inner sidewall 236.

The spreader channel 258 is a vertically defined channel, pathway, or void space located within the interior of the of the bladed body 256, comprising a spreader inlet 268. After the positioning of the bladed body 256 within the channel 214, the spreader channel 258 is aligned with the neck channel 240. Further, the spreader channel 258 is fluidly coupled to the neck channel by aligning the opening 246 with the spreader inlet 268. Through such alignment, the neck channel 240 is fluidly coupled to the spreader channel 258, providing for the transfer of the adhesive material through the neck channel 240 into the spreader channel 258.

The plurality of spreader openings 260 is a plurality of outlets located on the bladed body 256. Each spreader opening of the plurality of spreader openings 260 is a channel or pathway fluidly coupled to the spreader channel 258. In embodiments, the plurality of spreader openings 260 are located on the tapered tip 264. Additionally, the plurality of spreader openings 260 are further located on each lateral side of the bladed body 256. For example, in embodiments, the bladed body 256 comprises three spreader openings 260 on each lateral side. The positioning of spreader openings 260 disperses adhesive material 204 on each of the first portion 130 and the second portion 132 of the storage container 102.

In embodiments, the adhesive spreader 210 is retained within the channel 214 through at least one mechanical faster 270, coupling the bladed body 256 to the zipper housing 208. For example, at least one mechanical fastener 270 can be a screw, bolt, rivet, or other fastener. However, the at least one mechanical fastener 270 can be any known fastener. In embodiments, the at least one mechanical fastener is inserted through the zipper housing 208 and into the bladed body 256. For example, in embodiments in which the at least one mechanical fastener 270 is a screw, the mechanical fastener threads into the bladed body 256, pressing the bladed body 256 against the zipper housing 208, retaining the bladed body 256 in position within the channel 214. In embodiments, the mechanical fastener 270 is inserted into the zipper housing 208 at the distal end. Accordingly, when coupled, the bladed body 256 is positioned approximate to the proximal end 222 of the zipper housing 208.

In embodiments, each of the zipper housing 208 and the bladed body 256 comprise features or structural components to aid in coupling. For example, in embodiments, the zipper housing 208 comprises a passthrough 272. The passthrough 272 is a pre-drilled or pre-made opening in the zipper housing 208 configured for accepting the mechanical fastener 270. Accordingly, after use, the adhesive spreader 210 may be selectively installed and removed from the zipper housing 208. The adhesive spreader 210 may be removed for cleaning, repair, storage, or swapping out different embodiments of adhesive spreader 210.

Additionally, in embodiments, the bladed body 256 also comprises structural features to facilitate coupling with zipper housing 208. For example, the bladed body 256 may comprise a flange 274 or another extending member for accepting the mechanical fastener. The flange 274 may be located at the connection point between the mechanical fastener 270 and the bladed body 256. In embodiments, the size of the flange 274 or the length the flange extends away from the bladed body 256 is dependent on the size of the mechanical fastener 270. For example, the length of the flange 274 is long enough for the mechanical fastener to thread into the flange 274 providing a secure coupling. The flange 274 also provides enough material for the mechanical fastener 270 to thread into the bladed body 256 without entering the spreader channel 258.

Adhesive Container

Figure 7:
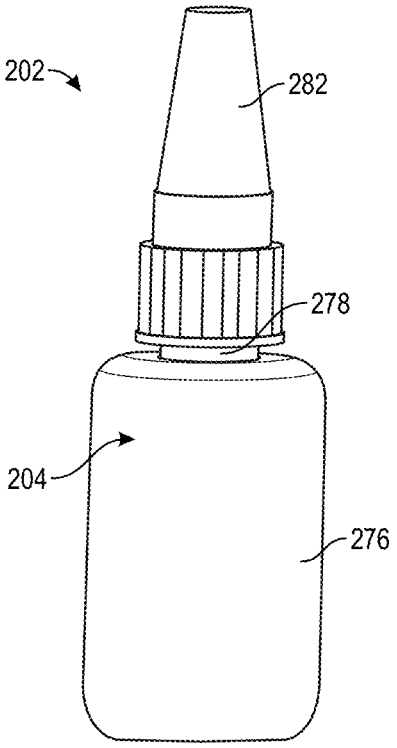
FIG. 7 depicts one example of a perspective view of an adhesive container.
Figure 8:
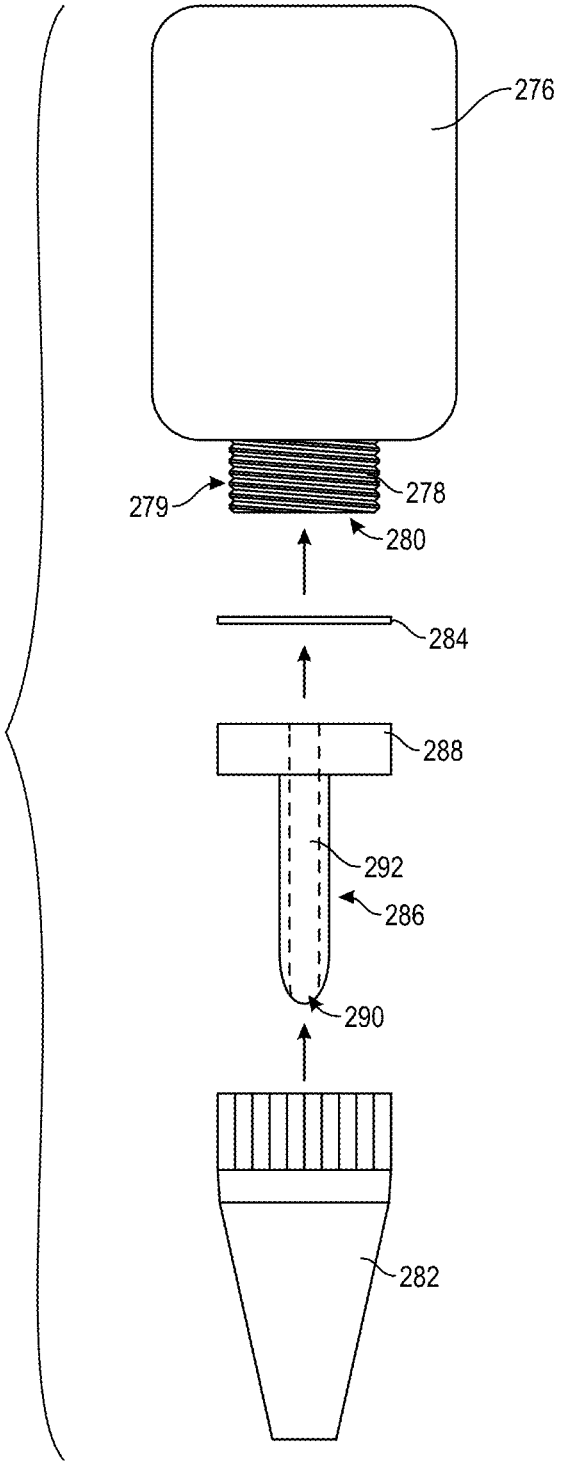
FIG. 8 depicts one example of an exploded view of an adhesive container.

The adhesive container 202 of the adhesive dispensing apparatus 104 is a storage container for storing the adhesive material 204. As best depicted in FIGS. 7-8, the adhesive container 202 comprises a squeezable body 276, a threaded end 278, an opening 280, a cap 282, a seal 284, and a dispensing tip 286.

The squeezable body 276 is a flexible storage unit for holding adhesive material 204 prior to dispensing. The squeezable body 276 comprises a form factor adapted for manipulation by the hand or fingers of an operator for squeezing. Accordingly, the squeezable body 276 may comprise a geometric design allowing an operator to grasp and squeeze the squeezable body 276 to dispense adhesive material 204. For example, the squeezable body 276 may comprise a cubic or prism design.

The threaded end 278 of the squeezable body 276 is an extending portion, extending away from the main body of the squeezable body 276. In embodiments, the threaded end 278 comprises a narrow or smaller circumference or dimension than the remaining portion of the squeezable body 276. Particularly, the threaded end 278 comprises a matching circumference or dimension to the neck 216 of the zipper housing 208. The matching dimensions of the threaded end 278 and the neck 216 provide for mating and coupling of the squeezable body 276 and the zipper housing 208. Specifically, the threaded end 278 is inserted into the neck channel 240. In embodiments, the threaded end 278 comprises threading 279 for locking or retaining the threaded end 278 in the neck channel. Specifically, the threading of the threaded end 278 mates with the threading 254 of the neck 216. The threaded end further comprises the opening 280. The opening 280 is the outlet of the squeezable body 276, providing the void space for the adhesive material 204 to flow out from the squeezable body.

In embodiments, the seal 284 is a temporary covering placed over the opening 280 on the threaded end 278. The seal 284 may be a thin strip of material having adhesive applied to one side for placement on the threaded end 278. The seal 284 may provide additional blocking to the opening 280, preventing the flow of adhesive material 204 out of the squeezable body 276. Additionally, or optionally, the seal 284 provides a tamper-evident effect, providing an indication as to whether the squeezable body 276 has been opened or tampered with. In embodiments, the seal 284 is removed prior to the dispensing of adhesive material 204 into the neck channel 240. In embodiments, the seal 284 is punctured by the cutting device 255 located within the neck channel 240. In further embodiments, an operator may physically remove the seal prior to coupling the squeezable body 276 to the neck 216. For example, the operator may simply remove the seal 284 using the operator's fingers.

In embodiments, the cap 282 is a covering or endcap for blocking the opening 280, thereby preventing the flow of adhesive material 204 from the squeezable body 276 after the seal 284 has been removed and/or to prevent the release of adhesive material 204 if the seal 284 has been inadvertently removed. For example, the cap 282 may be a plastic bottle cap comprising threading to thread onto the threaded end 278. In embodiments, the cap 282 is placed on the threaded end 278 during storage or transport of the adhesive dispensing apparatus 104 and removed prior to use. As described below, the adhesive container 202 may comprise an optional and/or additional dispensing tip 286, providing the operator to manually dispense adhesive material 204 without the dispensing zipper 200. In embodiments, the cap 282 may comprise a shape and form factor for accommodating the dispensing tip 286 once placed on the adhesive container 202.

In embodiments, the dispensing tip 286 is an optional and/or additional fine point attachment for the squeezable body 276, allowing the operator to dispense adhesive material 204 without the dispensing zipper 200. For example, if the dispensing zipper 200 becomes damaged, clogged, or otherwise becomes inoperable, the operator may attach the dispensing tip 286 to the adhesive container 202 to manually dispense adhesive material 204. Additionally, the dispensing tip 286 may also allow the operator to dispense additional adhesive material 204 for sealing the storage container 102 if there are any gaps or spaces following use of the dispensing zipper 200.

In embodiments, the dispensing tip 286 comprises a coupling end 288, a fine point dispensing tip 290, and a hollow lumen 292 disposed between the coupling end 288 and the dispensing tip 290. The coupling end 288 of the dispensing tip 286 is compatible with the threaded end 278 of the squeezable body 276 for coupling the dispensing tip 286 to the squeezable body 276. For example, coupling end 288 may comprise threading to thread with the threaded end 278. The fine point dispensing tip 290 is an opening located at the opposite end of the dispensing tip 286 away from the coupling end 288. The fine point dispensing tip 290 comprises a circumference of approximately 0.550 inches to about 1.040 inches. The hollow lumen 292 is a channel located within the dispensing tip 286, providing a fluid channel from the coupling end 288 to the fine point dispensing tip 290. In embodiments, the dispensing tip 286 is a selectively attachable and selectively removable tip for dispensing adhesive material 204 from the squeezable body 276 when the squeezable body is not coupled to the dispensing zipper 200. For example, following the deposition of adhesive material 204 to seal the storage container 102 using the dispensing zipper 200, the operator may attach the dispensing tip 286 to the squeezable body 276 to fill in any spots that require additional adhesive material 204.

In embodiments, the coupling end 288 may further comprise a cutting device, such as the cutting device 255 as described above with respect to the zipper housing 208, for puncturing or cutting through the seal 284. For example, if the operator has misplaced the zipper housing 208 or the zipper housing 208 has been damaged and the seal 284 is still located on the adhesive container 202, the threading of the dispensing tip 286 onto the adhesive container 202 may nonetheless puncture the seal 284. Once punctured, adhesive material 204 may flow through opening 280 and into the hollow lumen 292 of the dispensing tip 286.

The adhesive material 204 stored within the adhesive container 202 is a bonding agent for the eventual sealing of the storage container 102. The adhesive material 204 may comprise any known adhesive solution or adhesive material such as glue. In embodiments, the adhesive material 204 is UV curable (light-curing) bonding adhesive, including, for example, Loctite® 4306. However, other UV curable glues may be substituted. In embodiments, UV curable glue is advantageous to use because of the reliability of use in extreme temperature conditions. UV curable glue in consistently reliable in both cold and warm weather conditions.

Figure 9:
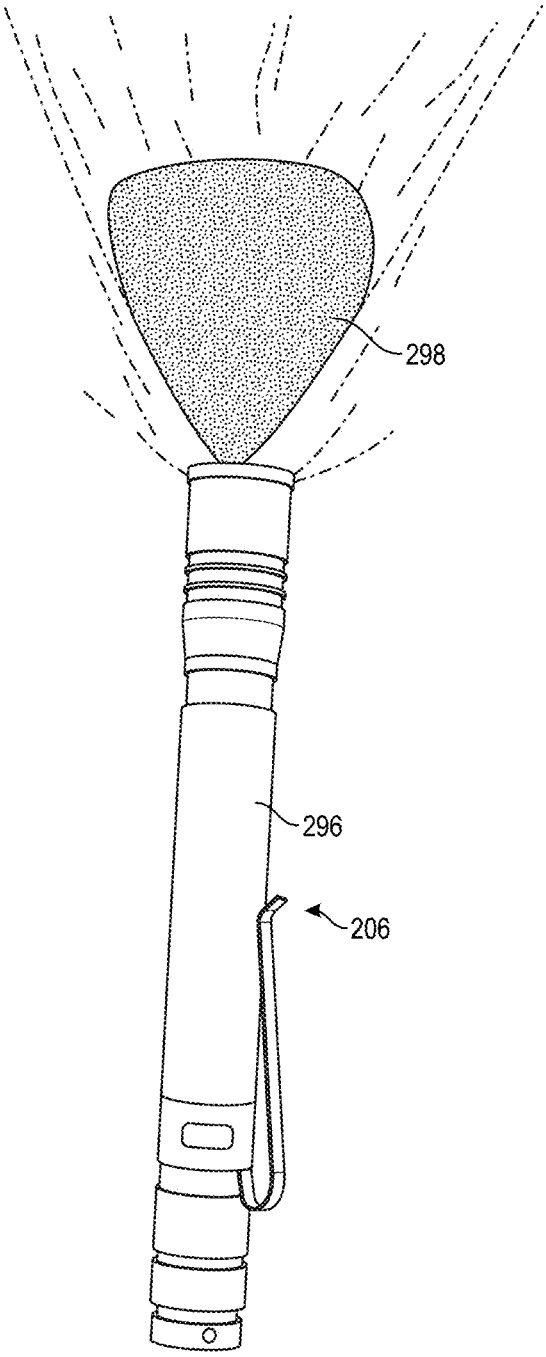
FIG. 9 depicts one example of a perspective view of a UV light source for curing UV curable glue.

In embodiments, the adhesive dispensing apparatus 104 is paired with a curing apparatus 206 for curing the adhesive material 204. In embodiments, the curing apparatus 206 is a UV light source 296, as depicted in FIG. 9. The UV light source 296 provides the UV light 298 required to cure the adhesive material 204 in embodiments in which adhesive material 204 is a UV curable glue. In embodiments, the UV light 298 is a handheld UV flashlight, capable of emitting the UV light 298 therefrom. After depositing of the adhesive material 204, the operator may use the UV light source 296 to cast UV light 298 onto the deposited adhesive material 204.

In further embodiments, the adhesive material 204 may optionally and/or additionally comprise visual indicators 294 to assist the operator in determining whether the storage container 102 has been properly sealed. For example, in embodiments, the visual indicators 294 may be fluorescent indicators dispersed throughout the adhesive material 204 which may react to an ultraviolet light. Following depositing, the visual indicators 294 provide visual confirmation about the distribution and depositing of adhesive material 204. For example, the visual indicators 294 may alert the operator as to whether the adhesive material 204 has been sufficiently deposited in the opening 144 or if gaps or voids exist.

Dispensing Adhesive Material onto the Storage Container

Figure 10:
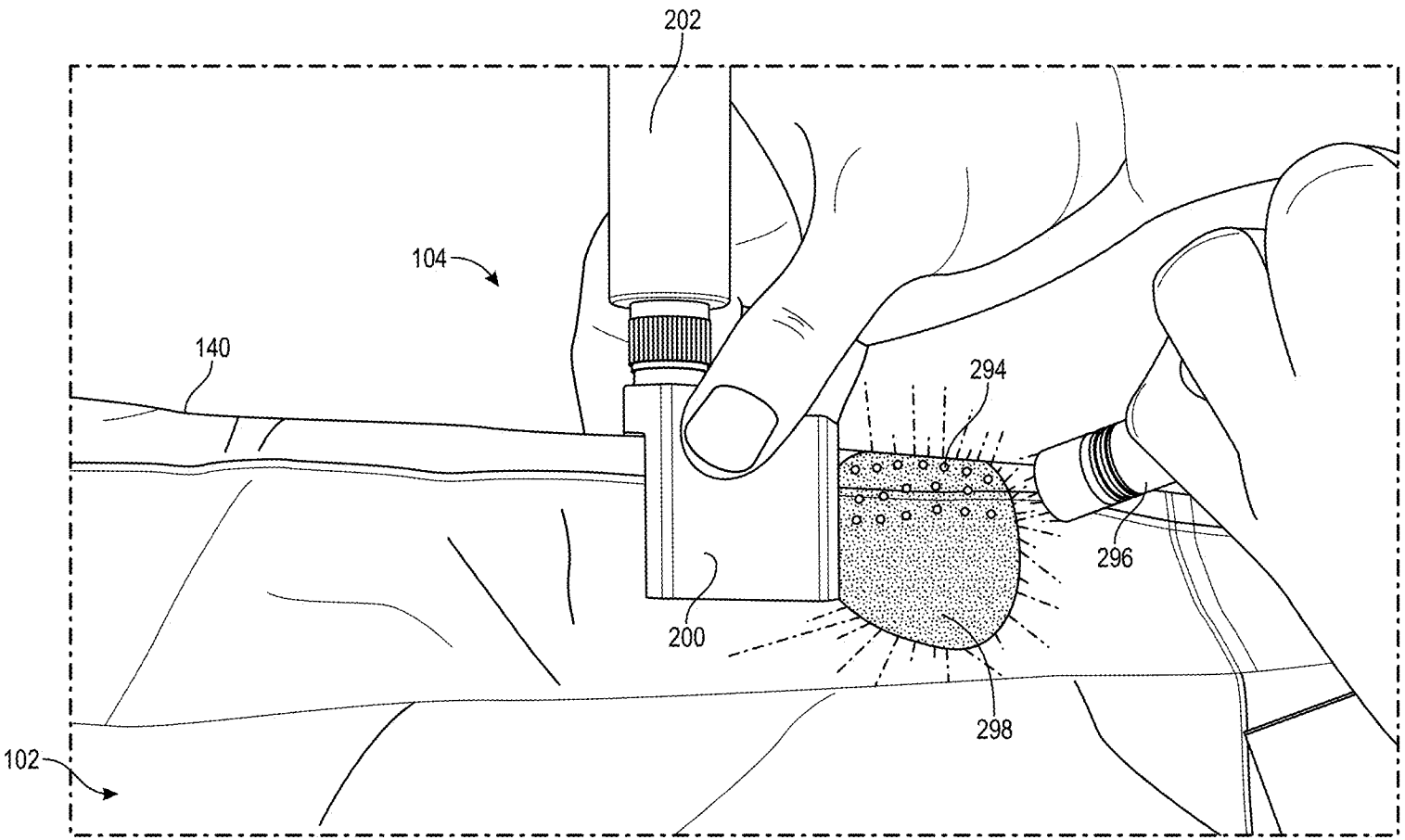
FIG. 10 depicts one example of a perspective view of an operator using the adhesive dispensing apparatus to seal a storage container.

As best depicted in FIGS. 3 and 10, the assembled dispensing zipper 200 is placed on the top sidewall of the 140 of the storage container 102 during the dispensing of adhesive material 204. Specifically, the top sidewall 140 is inserted into the U-shape of the zipper housing 208, placing the top sidewall 140 into the channel 214. During placement, the bladed body 256 is inserted into the space or gap between the currently unbonded first portion 130 and second portion 132. Additionally, the dispensing zipper 200 is positioned so that the bladed body 256 engages with the interior surface 133*b* of the first portion 130 and the interior surface 135*b* of the second portion 132. Further, when the inner sidewall 232 of the zipper housing 208 also engages with the first portion 130 and the second portion 132. Specifically, the exterior surface 133*a* of the first portion 130 and the exterior surface 135*a* of the second portion engages with either the right inner sidewall 232 or the left inner sidewall 236, depending on the position that the dispensing zipper 200 is initially placed on the storage container 102.

After the initial placement of the assembled dispensing zipper 200 on the top sidewall 140 the operator may translationally slide the dispensing zipper 200 along the top sidewall 140, as shown in FIG. 10. As the dispensing zipper 200 is slid along the top of top sidewall 140 two events occur. First, the adhesive material 204 is dispensed from the adhesive container 202 and follows the following pathway: immediately after exiting the opening 280 of the threaded end 278, the adhesive material 204 enters the neck channel 240 and is funneled into the inferior channel 252; the adhesive material 204 travels through the inferior channel 252 and enters the spreader channel 258 of the adhesive spreader 210; the adhesive material continues through the spreader channel 258 and exits the bladed body 256 through one of the spreader openings 260 thereby entering the channel 214 of the zipper housing. Second, as the dispensing zipper 200 is moved, the first portion 130 and second portion 132 incrementally enter the channel 214 encountering the adhesive material 204 that is being dispensed inside the channel 214. Specifically, as the dispensing zipper 200 is moving, the dispensed adhesive material 204 is deposited on each of the interior surface 133*b* of the first portion 130 and the interior surface 135*b* of the second portion 132.

As described above, the bladed body 256 comprises a plurality of spreader openings 260 on each lateral side, providing multiple depositing positions on the interior surface 133*b* of the first portion 130 and the interior surface 135*b* of the second portion 132. Accordingly, through the plurality of spreader openings 260 a greater surface area of the interior surface 133*b* of the first portion 130 and the interior surface 135*b* of the second portion 132 is covered by adhesive material 204. Further, as the dispensing zipper 200 is moved along the top sidewall 140, a near continuous depositing of adhesive material 204 occurs, increasing the bonding between the first portion 130 and the second portion 132. Further, as the dispensing zipper 200 is continually moved along the top sidewall 140, the portions of the first portion 130 and second portion 132 that adhesive material 204 has been applied to are pressed together upon exiting the channel 214. Particularly, as described above, the zipper housing 208 tapers at the distal end 226 and/or the channel 214 narrows at outlet 224. Accordingly, upon exiting the channel 214, the first portion 130 and second portion 132 are pressed together, promoting the bonding effect of the adhesive material 204.

The operator may continue to slide the dispensing zipper 200 along the entire length of the top sidewall 140, depositing adhesive material 204 and pressing the first portion 130 and the second portion 132 together. Upon reaching the end of the top sidewall 140, the operator may remove the dispensing zipper 200 from the top sidewall. Following the removal of the dispensing zipper 200, the opening of the storage space 114 of the storage container 102 is now sealed, and the storage container 102 is closed. In embodiments, in which adhesive material 204 is a UV curable glue, the operator may further cure the deposited adhesive material 204 using the UV light source 296. In embodiments, the operator may hold the dispensing zipper 200 in one hand and the UV light source 296 in the other and cure the adhesive material 204 immediately upon dispensing.

Outer Carrier

Figure 11:
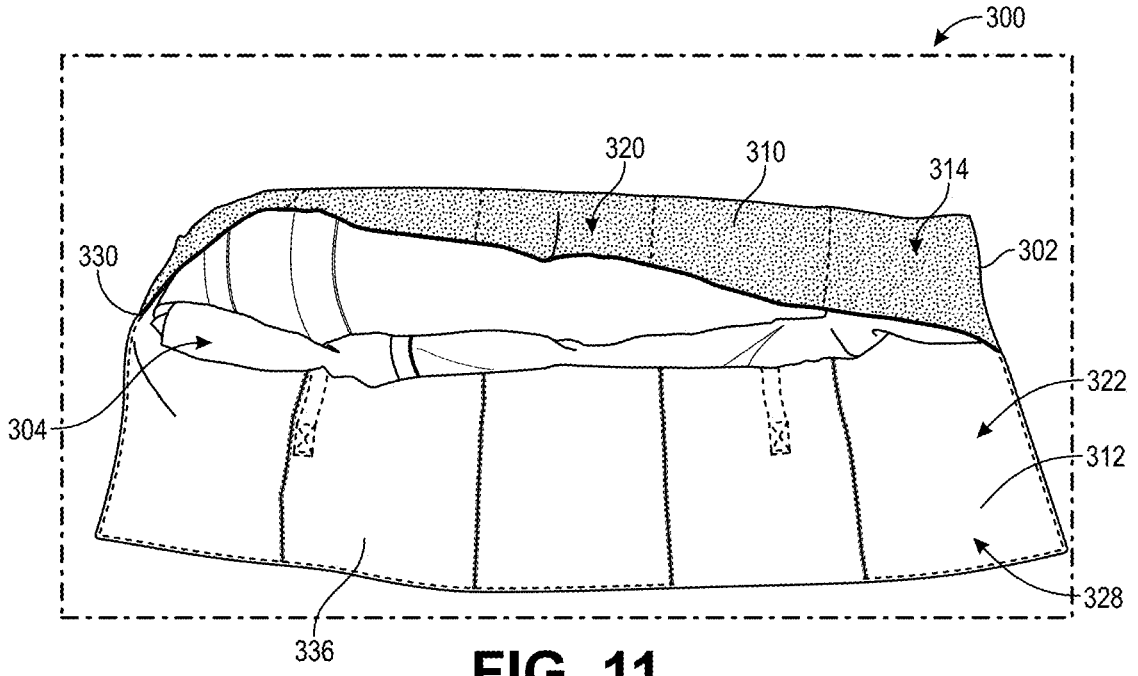
FIG. 11 is one example of a first perspective view of a carrier.
Figure 12:
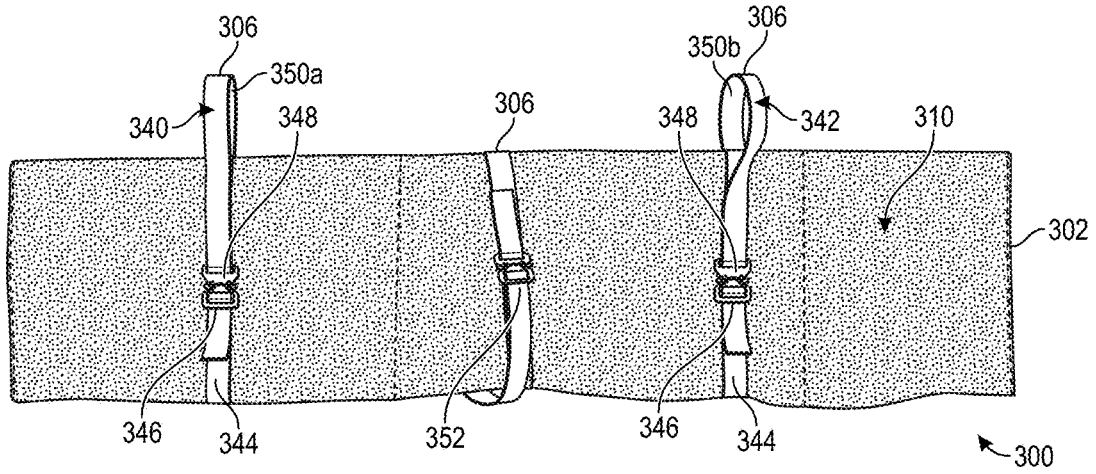
FIG. 12 is one example of a second perspective view of a carrier.
Figure 13:
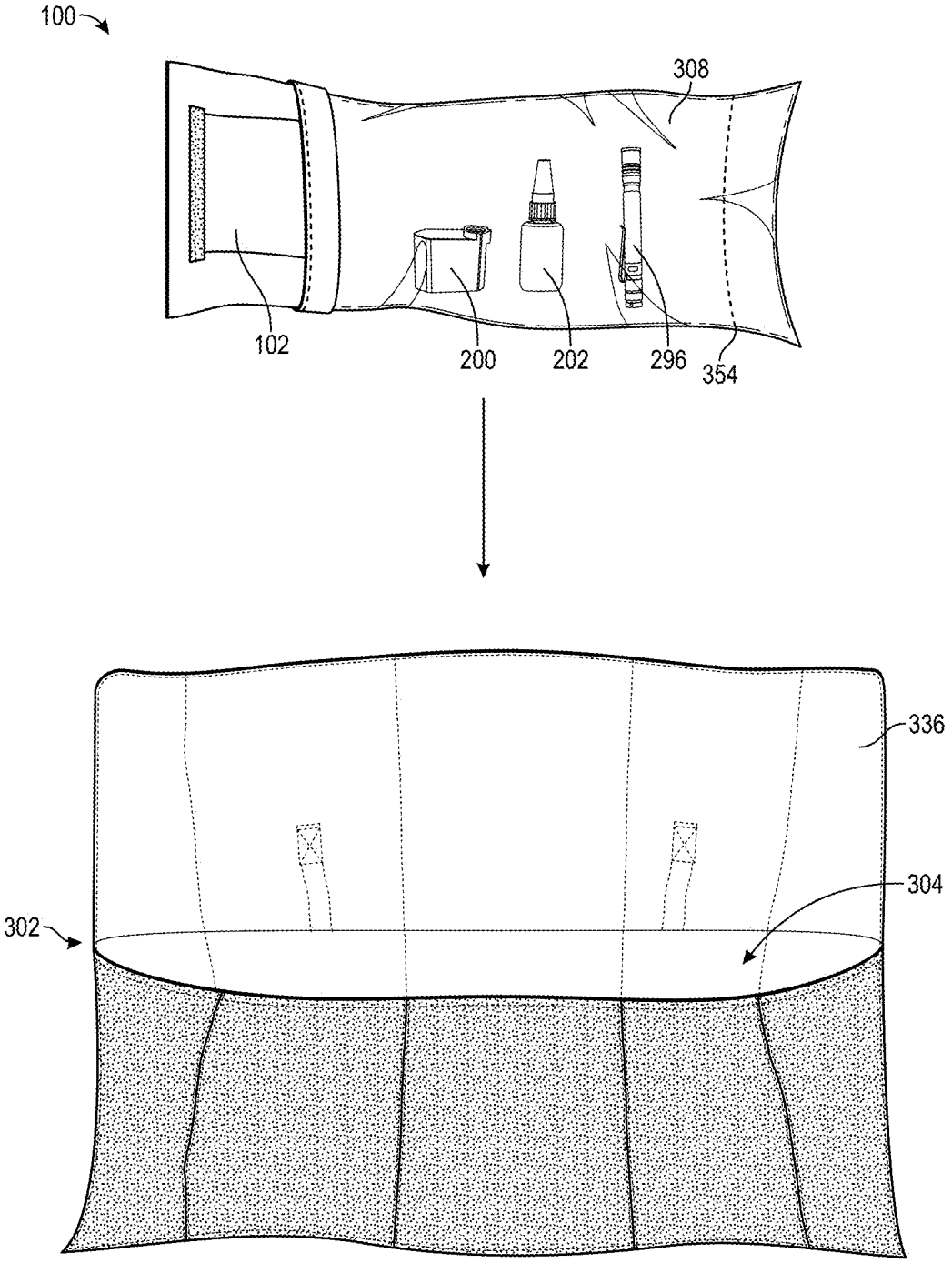
FIG. 13 is one example of a perspective view of a carrier and a components packaging.

The carrier 300 of the isolation bag 100 is a carrying case for storing the other components of the isolation bag 100, protection for the object, and/or provides a multi-faceted physical protection to objects. As depicted in FIGS. 11-13, the carrier 300 comprises a dual lined case 302, a storage pouch 304, cinching and carrying straps 306, and components packaging 308.

The dual lined case 302 of the carrier 300 comprises a protective exterior shell 310 and an interior liner 312 that when assembled, comprises a carrier sidewall 330. The exterior shell 310 of the dual lined case 302 is the outer layer of the carrier 300, constructed from a durable material 314 and comprising a first color 320. The exterior shell 310 provides the overall design, size, and shape of the carrier 300, and can be designed in a variety of shapes, sizes, and configurations. For example, in the depicted embodiment, the exterior shell 310 comprises a rectangular geometric design. However, the shape of the exterior shell 310 can be manufactured into any geometric shape. Further, the size of the exterior shell 310 is also variable but is larger in size than the storage container 102. As described in greater detail below, the storage container 102 is inserted into the carrier 300 for transportation. In embodiments, the dimensions of the exterior shell 310 are approximately 42 inches by 10.33 inches.

In embodiments, the exterior shell 310 is constructed from a sturdy, rugged, flexible, and/or otherwise durable and material 314 suitable for certain scenarios that the isolation bag 100 can be deployed in. Accordingly, in embodiments, the durable material 314 is resistant to abrasions, cuts, and/or punctures. Accordingly, the durable material 314 provides protection to the storage container 102 after the storage container 102 has been placed in the carrier 300 with object 108. For example, in embodiments, the durable material 314 is constructed from a nylon material, including woven nylon. In further embodiments, the exterior shell 310 is constructed from polyester, including laminated polyester fabric. In further embodiments still, the durable material 314 is constructed from synthetic fibers, including for example Kevlar®. In even further embodiments, the durable material 314 is a blending of fabrics, including a blend of nylon and polyester. Accordingly, in addition to a physically protective material, the exterior shell 310 further comprises a degree of formability, foldability, or general flexibility for manipulation of size, shape, or form factor. In further embodiments, the exterior shell 310 may be treated or coated with a water-resistant coating, providing additional protection to items or objects stored in the carrier 300.

The exterior shell 310 further comprises a first color 320. The first color 320 can be any color or combination of colors. In embodiments, the first color 320 may be a dull, drab, or dim color to help contrast with the interior liner 312 as described in greater detail below. In embodiments, the first color 320 may be an indication or warning as to the purpose of the isolation bag 100, including the type or risk level associated with the object 108. For example, the first color 320 may be a dull green color conveying to an observer that the object 108 may be an undetonated explosive, or alternatively the first color 320 may be a dull brown color conveying to the observer that the object 108 may be an unknown chemical agent. In further embodiments, the first color 320 may correspond to the intended use scenario. For example, in military scenarios, the first color 320 may be a camouflaged pattern.

The interior liner 312 is constructed from a protective material 322, which may be identical to the durable material 314 of the exterior shell 310. Constructing the interior liner 312 from the same material as the durable material 314 provides both an economic benefit and additional protection capabilities. However, in further embodiments, the protective material 322 may be constructed from a different material from the durable material 314. For example, in embodiments, the protective material 322 may be constructed from nylon, polyester, cotton, polypropylene, or other similar materials.

Additionally, in embodiments, the protective material 322 may comprise a degree of padding. The padding of the protective material 322 provides cushioning and additional protection to the contents of the carrier 300, including the object 108.

Additionally, in embodiments, the interior liner comprises a second color 328. The second color 328 is a contrasting color, visibly distinct from the first color of the exterior shell 310. In embodiments, the second color 328 may be orange, yellow, green, or other bright and/or fluorescent colors. The contrasting color of the second color 328 as opposed to the dull or drab color of the first color 320 provides an indication of a potential breach of the dual lined case 302 and/or the storage pouch 304. As described in greater detail below, the dual lined case 302 may be folded so that only the exterior shell 310 is visible. In the event of a tear, puncture, or other breach of the exterior shell 310, the interior liner 312 may be visible, providing an indication of a potential problem. Through use of the contrasting second color 328, such a tear, puncture, or other breach may be readily apparent and visible for detection. Similar to the first color 320, the second color 328 may also provide an indication of what type of item is being transported within the carrier 300.

In even further embodiments, the exterior shell 310 and/or the interior liner 312 may be treated with neutralizing materials in the event of leaks or punctures to the storage container 102. For example, in the event of a puncture of the carrier 300 that causes damage to the storage container 102, the neutralizing materials may prevent or mitigate contamination or a chemical reaction to the object 108. Upon detection, the neutralizing materials may further protect the object 108 until the operator can transfer the object 108 to a new storage container 102. The exterior shell 310 and/or the interior liner may be treated with neutralizing materials such as sodium bicarbonate or sodium hypochlorite.

During construction, the interior liner 312 is laid onto and coupled to the exterior shell 310 to form the dual lined case 302. For example, the exterior shell 310 and the interior liner 312 can be sewn together at the edges. However, the interior liner 312 and the exterior shell 310 can be bonded or coupled together using any method or technique, including for example adhesive, heat sealed treatments, among other sealing techniques.

The storage pouch 304 of the carrier 300 is a storing area of the carrier 300, providing a space for the insertion, receiving, and storing of items. As described in greater detail below, the components packaging 308 may be stored within the storage pouch 304 prior to use and after sealing the object 108 within the storage container 102, the storage container 102 can be stored within the storage pouch during transport. In embodiments, the storage pouch 304 is a pocket, pouch, or other containment unit located on the dual lined case 302. The size of the storage container 102 may vary depending on the embodiment but is large enough in dimensions to accommodate the size of the object 108. By way of non-limiting example, may comprise a volume of approximately 0.25 cubic liters to 5 cubic liters.

In embodiments, the storage pouch 304 is formed from the dual lined case 302, requiring no additional materials. For example, during construction, and after the coupling of the interior liner 312 and the exterior shell 310 to form the dual lined case 302, the dual lined case 302 is folded over on itself. For example, the dual lined case 302 may be folded over at approximately ⅓ of the total length of the dual lined case 302. After folding, the outer edges of the overlapping material of the dual lined case 302 are sealed or bonded. Accordingly, after sealing the storage pouch 304 comprises three sealed sides and an open side. Items, such as the storage container 102, can be selectively inserted and removed from the storage pouch 304.

In embodiments, the dual lined case 302 is folded inwardly, so that the exterior shell 310 is the exterior layer and the interior liner 312 is the inner layer of the storage pouch 304. Accordingly, when an item is inserted within the storage pouch 304, the item encounters only the interior liner 312 and not the exterior shell 310.

In further embodiments, the storage pouch 304 may be a cut piece of fabric or material that can be coupled to the dual lined case 302. For example, rather than folding and bonding the dual lined case 302, the material for the storage pouch 304 may be selectively placed on the surface of the interior liner 312 and bonded in place.

In embodiments, the flap 336 is a free portion of the dual lined case 302 extending away from the storage pouch 304. In embodiments in which dual lined case 302 is folded back on itself, the flap 336 is the remaining portion of the dual lined case that is not sealed to form the storage pouch 304. The flap 336 is used to selectively transition the carrier from an open to closed position. In the open position, the flap 336 is extended away from the storage pouch 304. In the closed position, the flap 336 is folded towards the storage pouch 304, covering the storage pouch 304.

The sealing and carrying straps 306 comprise at least one load bearing strap. In embodiments, the carrier 300 comprises a first strap 340 and a second strap 342. The first strap 340 and the second strap 342 may be identical, comprising the same features and components. For example, each of the first strap 340 and the second strap 342 comprises a length of material 344, comprising a first fastener 346, a second fastener 348, and a carrying handles 350*a*, 350*b*. The length of material 344 may be a durable, flexible material, such as nylon webbing, polyester webbing, paracord, cotton, rubber, plastic, or other suitable material. The first fastener 346 and the second fastener 348 are compatible mechanical fasteners for selectively coupling and mating. For example, the first fastener 346 and the second fastener 348 may be selected from buckles, hook and loop fasteners, magnets, buttons, or other mechanical fasteners. In embodiments, the first fastener 346 is a male buckle and the second fastener 348 is a female buckle. The carrying handles 350*a*, 350*b* are loops of material, located on each of the first strap 340 and the second strap 342. In embodiments, the carrying handles 350*a*. 350*b* are constructed from the same material as the material of the first strap 340 and/or the second strap 342.

In embodiments, the first strap 340 wraps around the carrier 300 in the closed configuration. Once wrapped around, the first fastener 346 and the second fastener 348 mate, thereby closing the loop of the first strap 340 against the carrier 300. Second strap 342 may be identically wrapped and secured around the carrier. In embodiments, the length of each of the first strap 340 and second strap 342 is adjustable. For example, the first fastener 346 and/or the second fastener 348 comprises a buckle or other apparatus for adjusting the length of the first strap 340 and/or the second strap 342. In further embodiments, the first strap 340 and/or the second strap 342 may comprise a buckle separate from the fasteners for adjusting the length of the first strap 340 and/or the second strap 342. In embodiments, each of the first strap 340 and the second strap 342 are shortened in length, tightening, or cinching against the dual lined case 302. The cinching of the first strap 340 and the second strap 342 thereby aid in maintaining the carrier 300 in the closed position.

In embodiments, each of the first strap 340 and the second strap 342 comprise a carrying handle 350*a*, 350*b*. Each carrying handle 350*a*, 350*b* is a loop of material, coupled to the respective strap. For example, carrying handle 350*a* is paired with first strap 340 and carrying handle 350*b* is paired with second strap 342. Accordingly, after securing each strap to the carrier 300, the operator has a handle to grab and carry the carrier 300. The carrying handles 350*a*, 350*b* may also be utilized as a coupling point for rope or other straps. For example, the operator may place the carrier on a utility vehicle and thread ratchet straps through the carrying handles 350*a*, 350*b* to secure the carrier to the vehicle. In further embodiments, carrying handles 350*a*, 350*b* may be integrally built into the carrier dual lined case 302. For example, handles 350*a*, 350*b* may be sewn into the exterior shell 310.

In embodiments, the carrier 300 may utilize additional straps that do not comprise a carrying handle. For example, if the object 108 is particularly heavy or has unwieldy weight distribution, the operator may decide that additional straps may be required to keep the object 108 from moving around in the storage pouch 304. Accordingly, a free floating third strap 352 may be secured around the carrier 300. In embodiments, the free floating third strap 352 is largely similar to first strap 340 and second strap 342 comprising a length of material 344, comprising a first fastener 346, a second fastener 348, but without comprising a handle.

As depicted in FIG. 13, in embodiments, the carrier 300 may further include a components packaging 308. The components packaging 308 may be a bag or other container for storing components and parts of the isolation bag 100. For example, in embodiments, the components packaging 308 may be a plastic bag having a perforated line 354, providing the operator with a convenient method of opening the components packaging 308 even when wearing protective gloves or gear. In embodiments, the components packaging 308 stores the storage container 102, the adhesive dispensing apparatus 104, and the UV light source 296. Accordingly, the isolation bag 100 acts as its own all-in-one storage unit, alleviating the need for the operator to store components in pockets or another storage bag. In embodiments, the components packaging 308 may further house replacement components or parts. For example, the components packaging 308 may store a primary storage container 102 and a secondary storage container 102 as a back-up or replacement in the event the primary storage container 102 is damaged, lost, or becomes unusable.

Method of Use

The isolation bag 100 may further include instructions or a manual instructing the operator how to use the isolation bag 100. For example, in embodiments, instructions may be printed on the carrier 300, may be stored in the components packaging 308, or provided as a standalone instruction booklet. At an initial step the operator is instructed to remove the storage container 102, the adhesive dispensing apparatus 104, and the UV light source 296 from the components packaging 308. As described above, the components packaging 308 may be stored within the storage pouch 304 of the carrier 300.

The operator inserts the object 108 into the storage container. As described above, the storage container 102 initially comprises opening 144 prior to the application of adhesive material 204. To prepare the storage container 102 for the insertion of object 108, the operator may spread the opening 144 increasing the distance between first portion 130 and second portion 132 to make insertion easier. Optionally, during this step, the operator may unfurl or unroll the carrier 300 to use as a workspace. For example, in certain scenarios, the operator may be deployed in a dirty or non-sterile environment. To keep the components of the isolation bag 100 relatively clean and free from debris, the unfurled carrier 300 may be used as a workspace. Accordingly, the operator may place the storage container 102, the dispensing zipper 200, and/or the curing apparatus 206 on the carrier 300 during operation.

Next, the operator is instructed to insert the object 108 into the storage container 102. Depending on the characteristics of the object 108, either known or unknown, the operator may insert the object 108 into the storage container 102 in a variety of ways. For example, if the object 108 is an undetonated explosive, the operator may roll the explosive into the storage container 102. Optionally, the operator may simply pick up the object 108 and place the object 108 in the storage container 102.

Next, the operator is instructed to assemble the adhesive dispensing apparatus 104. As described above, the adhesive dispensing apparatus 104 may start in a disassembled state to aid in transportation and/or to prevent inadvertent release or dispense of adhesive material 204. Accordingly, after the operator has been instructed to remove the adhesive dispensing apparatus 104, the operator is then instructed to assemble adhesive dispensing apparatus 104. For example, the operator may be instructed to thread the adhesive container 202 to the dispensing zipper 200.

Next, the operator is instructed to operate the adhesive dispensing apparatus. First, the operator is instructed to attach the assembled adhesive dispensing apparatus 104 to the top sidewall 140 of the storage container 102. After the adhesive dispensing apparatus 104 has been attached, the instructor is instructed to move the adhesive dispensing apparatus laterally along the top sidewall and dispense adhesive material 204 on each of the interior surface 133*b* of the first portion 130 and the interior surface 135*b* of the second portion 132. The operator continues to move the adhesive dispensing apparatus 104 along the entire length of the top sidewall 140 until reaching the terminal end. In addition to moving the adhesive dispensing apparatus 104, the operator is further instructed to cure the dispensed adhesive material 204 using the UV light source 296. In embodiments, the operator may be further instructed to apply pressure to the storage container 102 to remove air from the storage space 114.

Next, the operator is instructed to place the now sealed storage container 102 into the storage pouch 304 of the carrier 300. As described above, carrier 300 may be already unfurled for use as a workspace. If the carrier 300 is already unfurled, then the operator may immediately place the storage container 102 holding the object 108 into the storage pouch 304. If the carrier 300 has not already been unfurled, then the operator may be instructed to unfurl or unroll the carrier 300.

The operator is instructed to prepare the carrier 300 for transport. For example, the operator closes the flap 336 and wraps the straps 306 around the carrier 300. After the straps 306 are in position, the operator cinches or tightens the straps 306, thereby securing the storing container 102 within the carrier 300.

Upon reaching the destination, the operator is instructed to unfurl the carrier 300 and remove the storage container 102 from the storage pouch 304. Upon removal from the carrier 300, the object 108 can be removed from the storage container 102 for testing or other uses and the storage container 102 may be disposed of or destroyed. Additionally, after the storage container 102 has been removed the carrier 300 may be cleaned, repaired, decontaminated, and/or refurbished for subsequent uses.

Although the present disclosure has been described with reference to the embodiments illustrated in the attached drawing figures, it is noted that equivalents may be employed, and substitutions made herein without departing from the scope of the present disclosure as recited in the claims.

Having thus described various embodiments, what is claimed as new and desired to be protected by Letters Patent includes the following:

1. An isolation bag for transporting objects containing a chemical or biological substance, the isolation bag comprising:
- a storage container, the storage container comprising:
  - a first sealed sidewall and a second sidewall having a selectively transitional opening; and
  - a storage space for inserting an object into the storage container,
  - wherein at least a first portion of the storage container is constructed from a chemically resistant material and at least a portion of the second sidewall is chemically etched;
- an adhesive dispensing apparatus comprising:
  - a dispenser, the dispenser comprising:
    - an inlet opening located at a distal end of the dispenser;
    - an outlet opening located at a proximal end of the dispenser;
    - a channel disposed within an interior of the dispenser and defined by the inlet opening and the outlet opening;
    - an adhesive spreader at least partially disposed within the channel, comprising:
      - a vertical channel, and
      - a plurality of dispensing outlets fluidly coupled to the vertical channel; and
    - a neck comprising a void space that is fluidly coupled to the vertical channel; and
  - a selectively removable adhesive container for dispensing glue into the channel, the selectively removable adhesive container comprising:
    - a housing for storing an adhesive material; and
    - a threaded end comprising a void space,
    - wherein the selectively removable adhesive container is selectively insertable into the neck of the dispenser,
    - wherein the void space is fluidly coupled to the vertical channel for transferring adhesive from the housing to the adhesive spreader; and
- a carrier, the carrier comprising:
  - an outer shell having a first color;
  - an interior lining having a second contrasting color;
  - a storage pouch for receiving the storage container; and
  - at least one fastener for closing the carrier.

2. The isolation bag of claim 1, wherein the carrier further comprises a components packaging for storing the storage container and the adhesive dispensing apparatus, and the selectively removable adhesive container prior to use.

3. The isolation bag of claim 1, wherein the first color of the outer shell is green, and the second contrasting color is orange.

4. The isolation bag of claim 1,
- wherein the at least one fastener is an adjustable nylon strap,
- wherein the carrier further comprises a first adjustable nylon strap and a second adjustable nylon strap,
- wherein each of the first adjustable nylon strap and the second adjustable nylon strap comprises a carrying handle.

5. The isolation bag of claim 1, wherein the carrier further comprises a first portion and a second portion,
- wherein the storage pouch is located within a dimension of the first portion,
- wherein the second portion is a flap extending away from the first portion for folding back towards the first portion.

6. The isolation bag of claim 1,
- wherein the outer shell further is constructed from a nylon material,
- wherein the nylon material is coated with a water-resistant coating,
- wherein the nylon material is puncture, tear, and cut resistant.

7. The isolation bag of claim 1, wherein the adhesive material is a UV light curable glue.

8. An adhesive dispensing apparatus for sealing a storage container, the adhesive dispensing apparatus comprising:
- a dispenser, the dispenser comprising:
  - an inlet opening located at a distal end of the dispenser;
  - an outlet opening located at a proximal end of the dispenser;
  - a channel disposed within an interior of the dispenser and defined by the inlet opening and the outlet opening;

an adhesive spreader at least partially disposed within the channel, comprising:

a vertical channel; and a plurality of dispensing outlets fluidly coupled to the vertical channel; and a neck comprising a void space that is fluidly coupled to the vertical channel; and a selectively removable adhesive container for dispensing glue into the channel, the selectively removable adhesive container comprising:

a housing for storing an adhesive material; and a threaded end comprising a void space, wherein the selectively removable adhesive container is selectively insertable into the neck of the dispenser, wherein the void space is fluidly coupled to the vertical channel for transferring adhesive from the housing to the adhesive spreader.

9. The adhesive dispensing apparatus of claim 8, wherein the selectively removable adhesive container further comprises an adhesive backed seal covering the void space of the threaded end.

10. The adhesive dispensing apparatus of claim 9, wherein the dispenser further comprises a cutting tool disposed within the void space of the neck, wherein the cutting tool is a pointed tip or a circular cutting structure for piercing the adhesive backed seal.

11. The adhesive dispensing apparatus of claim 10, wherein each of the neck and the threaded end comprises threading for cooperatively mating the selectively removable adhesive container to the dispenser.

12. The adhesive dispensing apparatus of claim 11, wherein threading of the selectively removable adhesive container to the dispenser causes the cutting tool to breach the adhesive backed seal of the selectively removable adhesive container.

13. The adhesive dispensing apparatus of claim 8, wherein the adhesive spreader further comprises a first plurality of dispensing outlets located on a first lateral side and a second plurality of dispensing outlets on a second lateral side of the adhesive spreader.

14. The adhesive dispensing apparatus of claim 13, wherein each dispensing outlet of the first plurality of dispensing outlets and each dispensing outlet of the second plurality of dispensing outlets are fluidly coupled to the vertical channel.

15. A method of instructing insertion and transportation of an object having unknown characteristics in an isolation bag, the method comprising:

providing the isolation bag comprising a storage container, an adhesive dispensing apparatus, and a carrier;

said storage container comprising:

a first sealed sidewall and a second sidewall having a selectively transitional opening; and a storage space for inserting the object into the storage container, wherein at least a first portion of the storage container is constructed from a chemically resistant material and at least a portion of the second sidewall is chemically etched;

said adhesive dispensing apparatus comprising:

a dispenser, the dispenser comprising:

an inlet opening located at a distal end of the dispenser;

an outlet opening located at a proximal end of the dispenser;

a channel disposed within an interior of the dispenser and defined by the inlet opening and the outlet opening;

an adhesive spreader at least partially disposed within the channel, comprising:

a vertical channel, and a plurality of dispensing outlets fluidly coupled to the vertical channel; and a neck comprising a void space that is fluidly coupled to the vertical channel; and a selectively removable adhesive container for dispensing glue into the channel, the selectively removable adhesive container comprising:

a housing for storing an adhesive material; and a threaded end comprising a void space, wherein the selectively removable adhesive container is selectively insertable into the neck of the dispenser, wherein the void space is fluidly coupled to the vertical channel for transferring adhesive from the housing to the adhesive spreader;

said carrier comprising:

an outer shell;

an interior lining;

a storage pouch for receiving the storage container; and at least one fastener for closing the carrier;

instructing placement of the object into the storage container;

instructing sealing of the storage container with the adhesive material using the adhesive dispensing apparatus, wherein the adhesive dispensing apparatus dispenses the adhesive material into the selectively transitional opening;

after sealing of the storage container, instructing placement of the storage container into the storage pouch; and instructing closing of the carrier using the at least one fastener.

16. The method of claim 15, wherein the adhesive material is a UV curable glue, and wherein the method further comprises:

instructing curing of deposited adhesive material with a UV light source.

17. The method of claim 15, further comprising:

prior to placing the object in the storage container, instructing opening of the carrier, and removing the storage container from a components pouch stored in the storage pouch.

18. The method of claim 15, further comprising:

prior to instructing sealing of the storage container, instructing threading of the selectively removable adhesive container onto the dispenser.

19. The method of claim 15, further comprising:

instructing opening of a closed carrier and removing the storage container holding the object from the storage pouch; and instructing disposal of the storage container by destroying the storage container.

20. The method of claim 19, further comprising:

instructing decontamination and cleaning of the carrier for subsequent uses.

* * * * *